United States Patent [19]

Johansson

[11] 4,081,098

[45] Mar. 28, 1978

[54] CONTAINER LID HAVING GRIPPING MEANS

[75] Inventor: Göran Lennart Daniel Johansson, Malmo, Sweden

[73] Assignee: Aktiebolaget Skane-Emballage, Malmo, Sweden

[21] Appl. No.: 716,013

[22] Filed: Aug. 19, 1976

[30] Foreign Application Priority Data

Sep. 8, 1975 Sweden ..... 7509945

[51] Int. Cl.[2] ..... B65D 41/04; B65D 41/34

[52] U.S. Cl. ..... 215/329; 215/333

[58] Field of Search ..... 215/329, 333, 334, 335; 113/121

[56] References Cited

U.S. PATENT DOCUMENTS

| | | | |
|---|---|---|---|
| 2,008,585 | 7/1935 | Kramer | 215/333 |
| 3,465,908 | 9/1969 | Acton | 215/333 |
| 3,717,275 | 2/1973 | Willis | 215/329 |

*Primary Examiner*—George T. Hall

*Attorney, Agent, or Firm*—Brumbaugh, Graves, Donohue & Raymond

[57] ABSTRACT

The disclosure deals with a method of producing round lids with thread-engagement lugs. A round workpiece of rolled sheet metal is deep drawn to form a cup-shaped lid blank with a depending edge portion and during the deep drawing operation the depending edge portion is stamped with spaced finger grips. The finger grips are, seen from the center point of the round workpiece, stamped in four major directions which lie in the rolling direction of the rolled sheet metal and at right angles thereto. The lower edge of the stamped edge portion is then bent to form the finished lid and its thread-engagement lugs.

3 Claims, 8 Drawing Figures

CONTAINER LID HAVING GRIPPING MEANS

It is known to produce round lids with thread-engagement lugs by deep drawing a round workpiece consisting of rolled sheet metal into a cup-shaped lid blank and by bending the edge of the cup-shaped lid blank to form the thread-engagement lugs of the finished lid. It is also known, in conjunction with the deep drawing operation of the round workpiece, to stamp the edge portion of the resultant cup with spaced finger grips in the form of depressions around the circumference of the lid. This method of manufacturing round lids of rolled sheet metal is possessed of a serious disadvantage, in that the deep drawing of rolled sheet metal in the form of a round workpiece tends, as is well known, to give rise to so-called ear-formation at the free edge of the cup-shaped lid blank formed in the deep drawing operation. This ear-formation, which causes waviness in the edge line of the free edge, causes that the thread-engagement lugs formed by the subsequent bending of the abovementioned edge to be given different shapes and, in particular, different sizes. Thus, thread-engagement lugs formed at points corresponding to the ear-formation will be larger than those formed at other points around the circumference of the bent edge. These larger thread-engagement lugs can, in certain cases, be so large that the finished round lid cannot be brought into engagement solely by manual force into the thread of the container, for example, a glass jar or the like, for which the lid is intended. Consequently the lid must either be rejected or subjected to further processing for adjusting the size of the thread-engagement lugs. This rejection or further processing of faulty lids increases material consumption and makes the manufacturing process more expensive.

It has now proven that the waviness in the free edge of the cup-shaped lid blank caused by this ear-formation and the consequent formation of thread-engagement lugs of different sizes can be eliminated by the provision of finger grips in determined directions in relation to the rolling direction of the rolled sheet metal instead of, as was previously the case, providing finger grips throughout the entire circumference of the depending edge portion. This distribution of the finger grips makes possible a compensation for the ear-formation, such that the free edge of the cup-shaped lid blank will be substantially free of ear waves. In particular, it has proven to be specially suitable to provide, or stamp, the finger grips in four major directions which lie in the rolling direction and at right angles thereto.

The nature of the invention and its aspects will be more fully understood from the following description of the drawing and discussion relating thereto.

Figure 3:
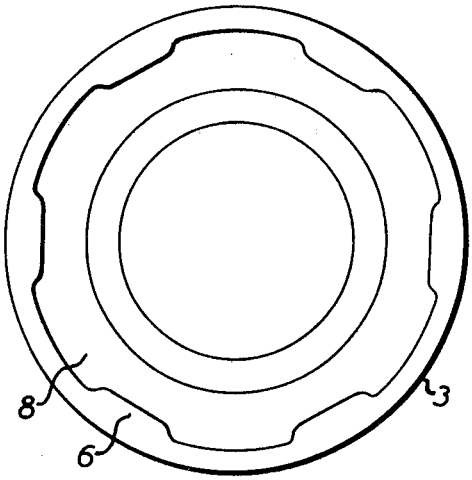
FIG. 3 is a view of the lid of FIG. 1, seen from beneath.
Figure 4:
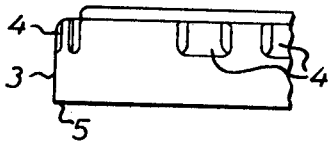
FIG. 4 shows the deep drawn lid blank from the side.
Figure 5:
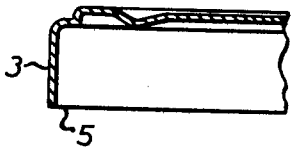
FIGS. 5, 6, 7 and 8 are sections corresponding to FIG. 2 and show successive stages in the bending of the deep drawn lid blank.
Figure 6:
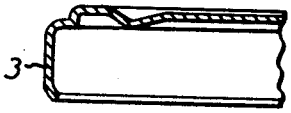
Figure 2:
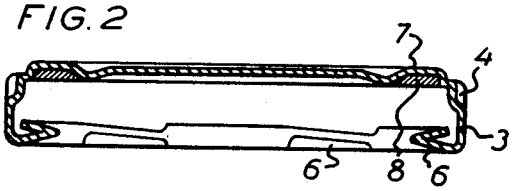
FIG. 2 is a section taken along the line II—II in FIG. 1.
Figure 7:
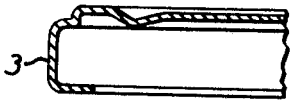
Figure 1:
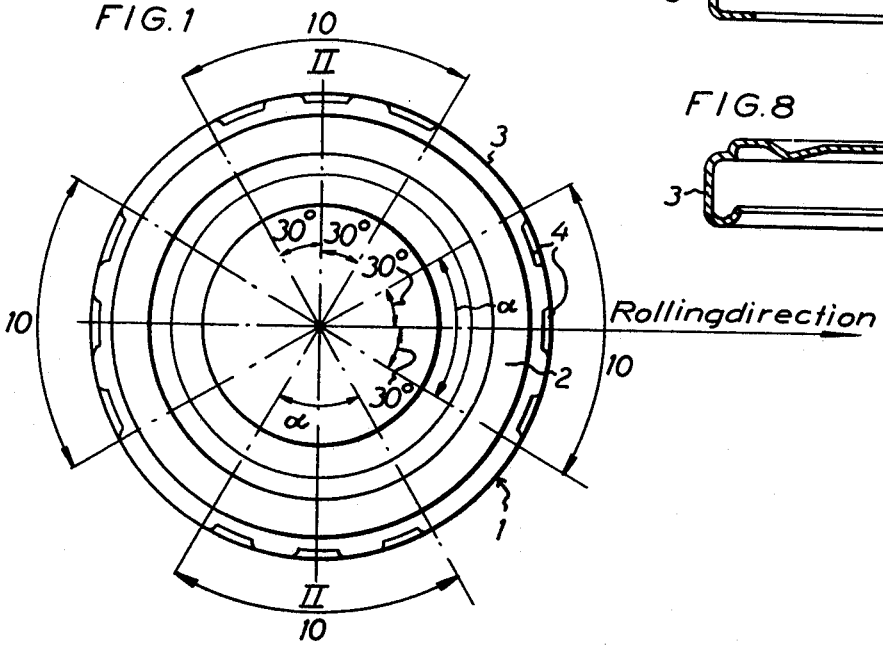
FIG. 1 is a top plan view of a lid according to the invention.
Figure 8:
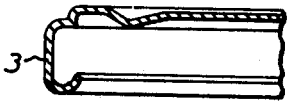

In the production of a round lid 1 by the method according to the invention, rolled sheet metal 2 in the form of a round workpiece is deep drawn, the depending edge portion 3 being stamped or provided in some other way with spaced groups of finger grips 4 in four major directions which lie in the rolling direction and at right angles thereto. The free edge 5 (FIG. 3) of the thus stamped, depending edge portion is bent or folded for the formation of thread-engagement lugs 6 of mutually the same size. The annular sealing surface 7 of the lid is also formed in conjunction with the deep drawing and stamping operation. This surface may possibly later be coated or filled with a sealing matrix 8 of, for example, a plastic material.

In a preferred method according to the invention, the depending edge portion 3 is stamped with finger grips 4 arranged in series 10, the central points of two successive series making angles of about 0° and about 90°, respectively, with the rolling direction of the rolled sheet metal and the stamping being effected such that each series occupies a sector angle $\alpha$ of 40°–70°, preferably 50°–60°.

Furthermore, it is preferable to stamp the depending edge portion 3 with finger grips 4 arranged in series such that each series contains an identical set of finger grips.

Within the spirit and scope of the invention, it is possible to carry out various modifications, for example, to vary the size, shape and number of the finger grips within each series, on condition that these series are arranged in the rolling direction of the rolled sheet metal and at right angles thereto.

What I claim and desire to secure by Letters Patent is:

1. A screw-lid or deep-drawn rolled sheet metal comprising:

a circular main body;

a continuous circumferential flange formed integral with said main body and depending from the periphery thereof;

thread-engagement lugs formed by bent portions of the free edge of said flange; and a plurality of circumferentially spaced finger-grips formed by indentations on said flange;

said spaced finger-grips being arranged in four equally spaced groups, the center points of said groups being oriented in four major directions, seen from the central axis of the lid, which major directions lie, two in the rolling direction of the rolled sheet metal of the lid and the other two at right angles thereto;

the spacing between every two adjacent finger-grips belonging to consecutive groups being greater than the spacing between adjacent finger-grips belonging to the same group.

2. A lid according to claim 1 in which each group of said finger-grips, seen from the central axis of the lid, embrace an angle of 40°–70°.

3. A lid according to claim 1, wherein the flange area between each of said four groups of finger-grips is smooth.

* * * * *